US005417588A

United States Patent [19]

Olson et al.

[11] Patent Number: 5,417,588

[45] Date of Patent: May 23, 1995

[54] COAX CONNECTOR WITH CENTER PIN LOCKING

[75] Inventors: Cynthia G. Olson, Carver; Dennis M. Burroughs, Savage, both of Minn.

[73] Assignee: ADC Telecommunications, Inc., Minneapolis, Minn.

[21] Appl. No.: 152,572

[22] Filed: Nov. 15, 1993

[51] Int. Cl.[6] ..... H01R 9/03; H01R 13/40

[52] U.S. Cl. ..... 439/585; 439/603

[58] Field of Search ..... 439/585, 603, 586

[56] References Cited

U.S. PATENT DOCUMENTS

| | | | |
|---|---|---|---|
| 3,336,563 | 8/1967 | Hyslop | 439/603 |
| 3,372,364 | 3/1968 | O'Keefe et al. | 439/585 |
| 3,439,294 | 4/1969 | Flanagan et al. | 439/585 X |
| 3,648,213 | 3/1972 | Kobler | 439/586 |
| 4,553,806 | 11/1985 | Forney, Jr. et al. | 439/585 X |
| 4,799,902 | 1/1989 | Lavdig et al. | 439/585 |

OTHER PUBLICATIONS

Trompeter Electronics, Inc. catalog pp. 34–40.

Amp, Inc. "Purchasing Guide 2005-7 Streamlined", pp. 68, 69, 74.

Amphenol Corp. publication "Amphenol RF Connectors" dated 1991, pp. 16–19, 26 27, 53, 56, 57.

Kings Electronics Co., Inc. 1989 catalog "RF Coaxial Connectors", pp. 4, 24–26.

Radial Inc. publication "Microwave RF Coaxial Connectors" IX 3–4, IX 22–23, IX 28–29.

Omni Spectra publication "Commercial Products RF/Microwave Connectors & Accessories", pp. 2–6.

*Primary Examiner*—Kenneth J. Ramsey

*Attorney, Agent, or Firm*—Merchant, Gould, Smith, Edell, Welter & Schmidt

[57] ABSTRACT

A connector for terminating coax cables includes a center pin mounted in a dielectric support. The support has a resilient locking arm which snaps into a recess of the center pin to prevent relative axial movement of the pin and the support.

3 Claims, 15 Drawing Sheets

COAX CONNECTOR WITH CENTER PIN LOCKING

I. BACKGROUND OF THE INVENTION

1. Field of the Invention

This invention pertains to connectors for terminating coaxial cables. More particularly, this invention pertains to such a connector which includes means to lock a center pin in place to eliminate relative axial movement of the center pin within the connector.

2. Description of the Prior Art

In the prior art, coaxial cable connectors (such as well-known BNC or TNC connectors) are commonly used to terminate coaxial cables. Coaxial connectors include a metallic housing having a cylindrical sleeve. Centrally disposed within the sleeve is a center contact pin. The center contact pin is maintained in coaxial alignment within the sleeve by means of a dielectric spacer. The geometry of the pin, spacer and sleeve are mutually selected for the BNC connector to have a prescribed characteristic impedance (for example, 75 ohms).

A coaxial cable consists of a center conductor wire surrounded by an inner dielectric sheathing. A flexible, tubular mesh of conductive material (referred to as a ground shield) surrounds the dielectric sheathing. Finally, an outer insulating sheathing would surround the shield.

In the prior art device, the center conductor of the coaxial cable is secured to the center pin of the BNC connector through any suitable means (for example, by crimping or solder). The grounded shield of the coaxial cable is secured to the BNC housing through any suitable means (commonly, by crimping). As a result, the cylindrical sleeve of the BNC connector is electrically grounded and the center pin is electrically connected to the center conductor of the coaxial cable.

From time to time, axial forces can be placed on a coaxial cable. In response to such forces, the center pin of the BNC connector experiences forces urging it to move axially within the sleeve. Such movement is undesirable. However, with the prior art designs of BNC connectors, the center pin would be susceptible to movement resulting from environmental effects (for example, axial forces applied to the cable) and temperature fluctuations (resulting in relative movement of the center pin due to different coefficients of expansion). If relative movement were to occur, it would be possible for the center pin to become disconnected from a second coaxial cable mated to the BNC connector. In this event, signal interruption could occur.

With prior art BNC designs (or alternatively TNC type connectors), relative movement of the center pin within the connector is common when extreme temperature fluctuations occur. However, since coaxial cables handle very fast transmission rates (for example, about 45 megabits per second), even low probability circuit interruptions are extremely undesirable. It is an object of the present invention to provide a coax cable connector which avoids movement of a center conductor pin.

II. SUMMARY OF THE INVENTION

According to a preferred embodiment of the present invention, a connector is provided for a coaxial cable. The connector includes a conductive housing having a mating end for releasable connection to a mating connector. The mating end has a hollow cylindrical sleeve.

A conductive center pin is disposed within the housing and has a pin receiving end disposed within the sleeve. A dielectric support is provided for supporting the center pin within the housing with the pin maintained in insulated, spaced relation to the housing. A lock mechanism locks the pin within the housing.

III. BRIEF DESCRIPTION OF THE DRAWINGS

IV. DESCRIPTION OF THE PREFERRED EMBODIMENT

Referring now to the several drawing figures in which identical elements are numbered identically throughout, a description of the preferred embodiment will now be provided. As will be more fully discussed, the present invention will be discussed in a preferred embodiment for use in a BNC or TNC type connector. However, it will be appreciated that the teachings of the present invention can be applied to other types of connectors for terminating coaxial cables.

Figure 1:
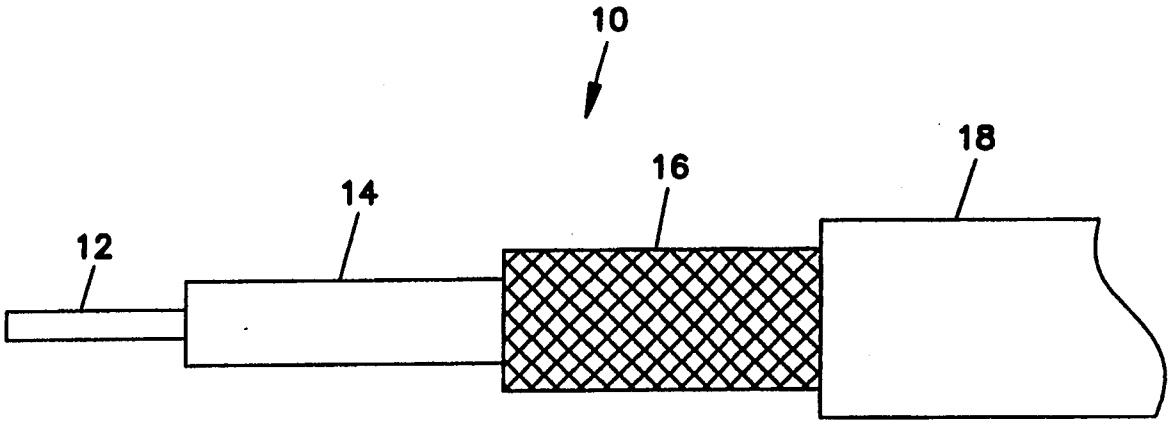
FIG. 1 is a side elevation view of a coaxial cable with various internal layers exposed.
Figure 2:
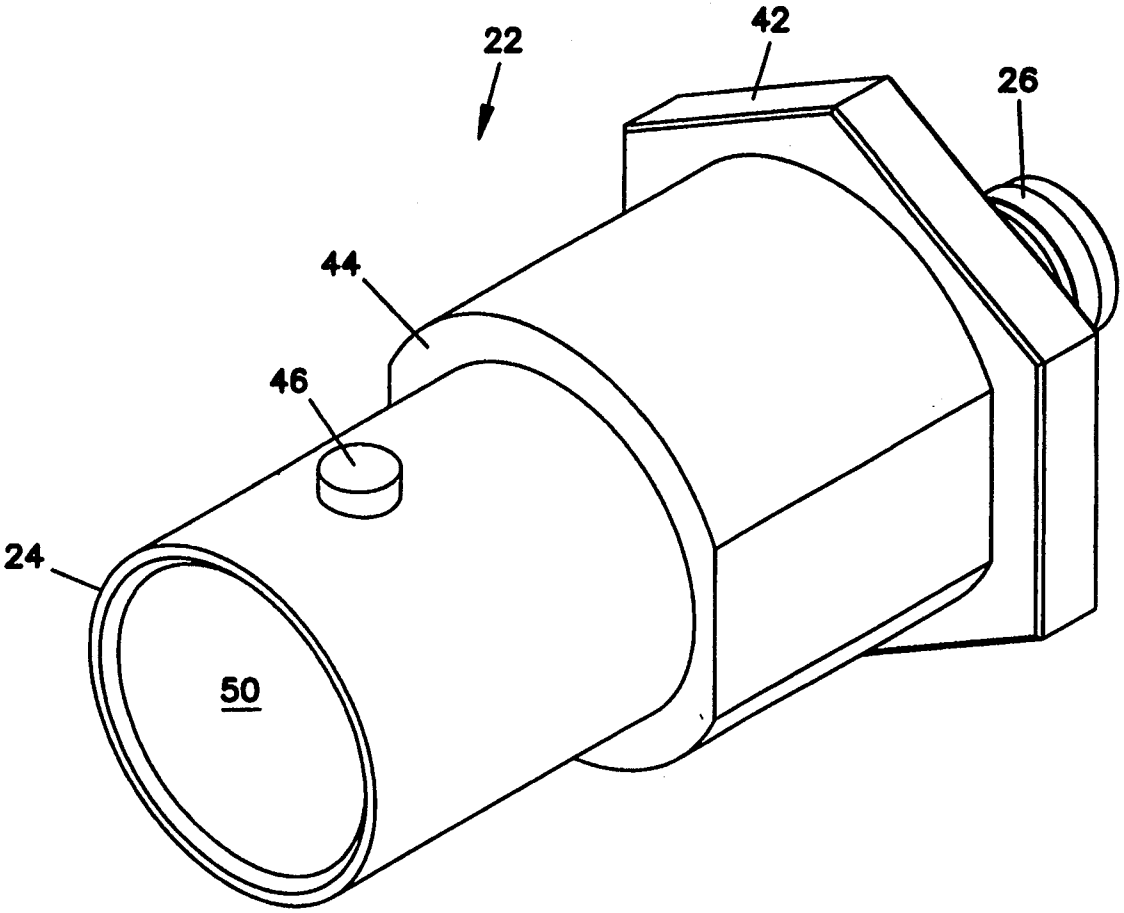
FIG. 2 is a perspective view of a housing for a connector according to the present invention.
Figure 3:
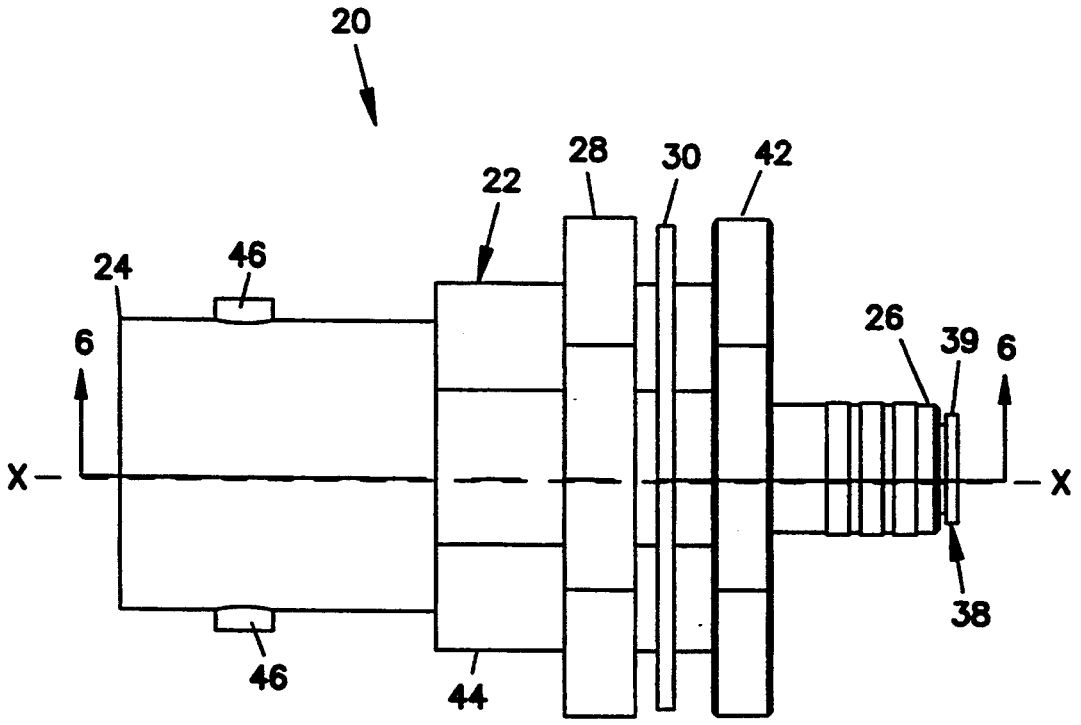
FIG. 3 is a top plan view of a connector according to the present invention.
Figure 4:
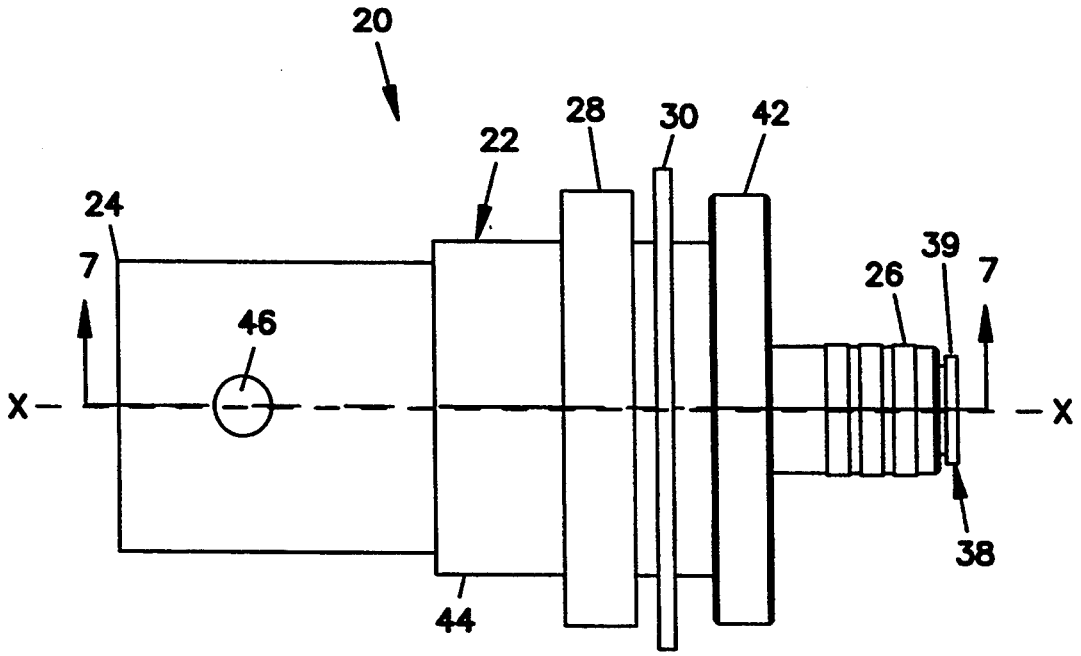
FIG. 4 is a side elevation view of the connector of FIG. 3.

With initial reference to FIG. 1, a coaxial cable 10 is shown with various layers stripped to expose an electrically conductive center conductor wire 12. A dielectric sheathing 14 surrounds the center conductor 12. A flexible, electrically conductive metallic mesh (commonly referred to as a ground shield 16) surrounds the dielectric sheathing 14. Finally, a synthetic plastic dielectric outer sheathing 18 surrounds the ground shield 16.

With initial reference to FIGS. 2–11, the present invention will be described in use in a BNC bulk head connector 20. The connector 20 (FIG. 3) includes a housing 22 having a mating end 24 for releasable connection to a mating connector (as will be described with connector 100 shown in FIGS. 12–19). The housing 22 also includes a crimp end 26 for crimping a coaxial cable (such as cable 10 in FIG. 1) to the connector 20. The particular construction shown is suitable for securing the BNC connector 20 to a sheet metal panel (not shown) of any suitable apparatus. With such construction, the coaxial cable 10 is hard wired to the crimp 26 and the opposite end 24 can be releasably connected or disconnected to another coaxial cable.

Figure 5:
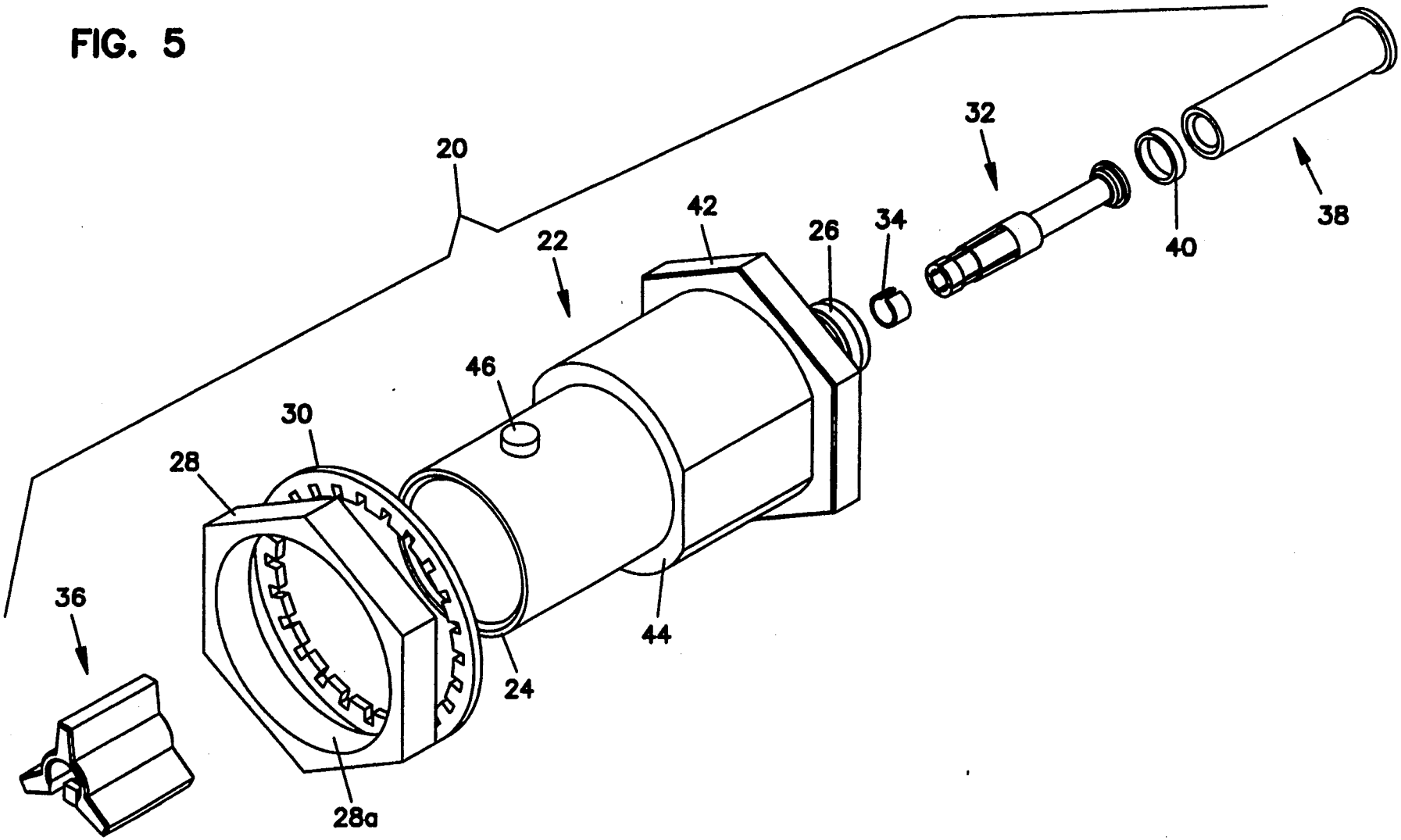
FIG. 5 is an exploded perspective view of the connector of FIGS. 3 and 4.

FIG. 5 best illustrates the components of the overall connector 20. In addition to housing 22, the connector 20 includes a nut 28 and washer 30 for securing the connector 20 to a panel (not shown). The connector 20 further includes a metallic, electrically conductive center pin 32 which, in a preferred embodiment, will include a retaining ring 34 (the function of which will be described). The connector 20 further includes a dielectric support 36 which will be more fully described. Also, for purposes that will become apparent, the connector 20 optionally includes a metallic spacer sleeve 38 and a dielectric, electrically insulating ring 40.

For attachment to a panel, the housing 22 includes a hexagon-shaped flange 42 integrally formed with the housing 22. Extending axially from the flange 42 is an enlarged housing portion 44 which is preferably provided with male threads on its exterior surfaces (the threads not being shown for purposes of clarity and since such threads are conventional in prior BNC connectors). The nut 28 is provided with female threads on its inner surface **28*a* to mate with the threads on surface 44 such that the nut 28 may be threaded onto the surface 44 with the washer 30 captured between nut 28 and flange 42. As a result, the housing 22 may be secured to a sheet metal panel or the like with the housing portion 44 passed through a hole in the panel and with the washer 30 and flange 42** positioned on opposite sides of the panel.

The mating end 24 is a hollow cylindrical sleeve which extends axially from the enlarged body 44 of the housing 22. The sleeve 24 is provided with diametrically opposed and radially extending posts 46 for use with connection to a mating connector 100 as is conventional.

Figure 6:
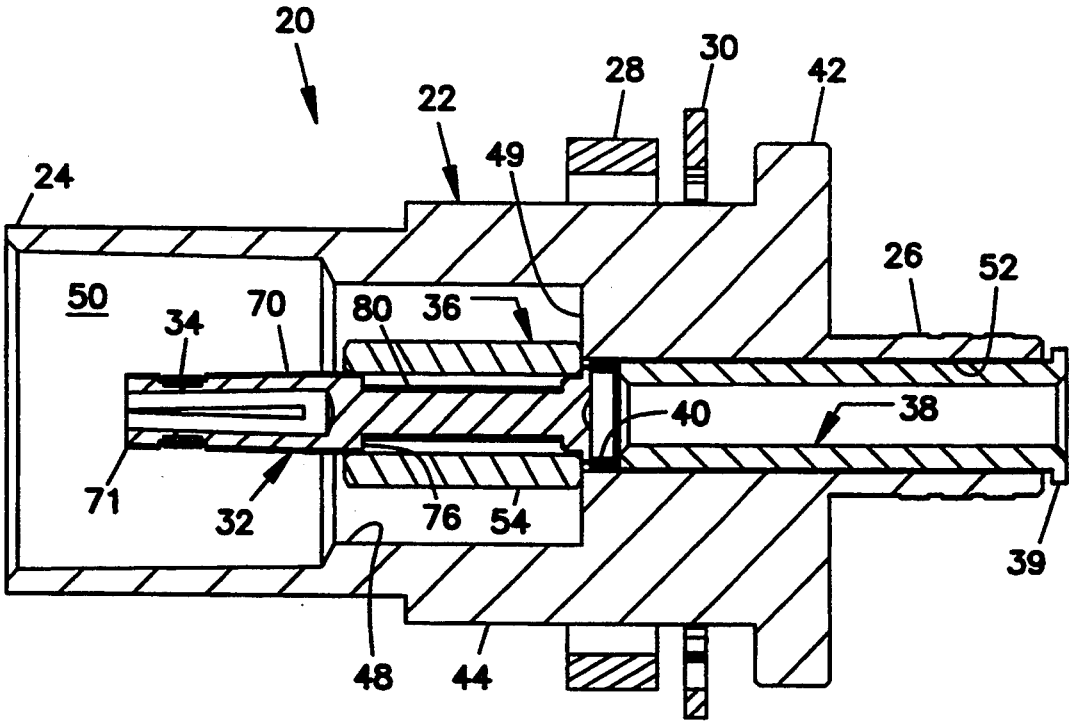
FIG. 6 is a view taken along line 6—6 of FIG. 3.
Figure 7:
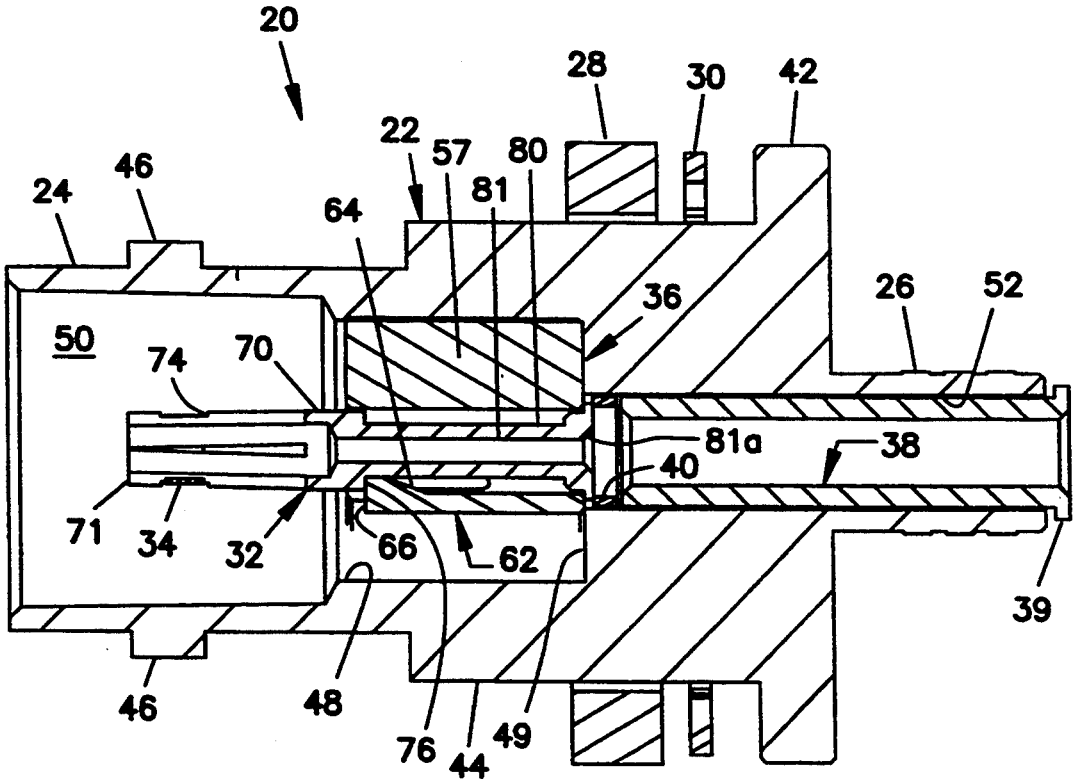
FIG. 7 is a view taken along line 7—7 of FIG. 4.

FIGS. 6 and 7 illustrate the assembled components of FIG. 5. In FIG. 6, the reader will note that line 6—6 of FIG. 3 (from which FIG. 6 is taken) is not drawn extending through the central axis (X—X) of FIG. 3 for purposes of clarity of illustration. Accordingly, the center pin 32 in FIG. 6 is shown solid. In FIG. 7, the view of FIG. 7 is taken along axis X—X as illustrated by the line 7—7 in FIG. 4 and, accordingly, shows the center pin 32 as a hollow pin.

As shown in both FIGS. 6 and 7, the housing 22 includes an intermediate cylindrical chamber 48. The internal surfaces of the sleeve 24 define a larger diameter, mating end cylindrical chamber 50 which is coaxially aligned with intermediate chamber 48. Finally, a cylindrical bore 52 is formed through the crimp end 26 in communication with and coaxially aligned with the intermediate cylindrical chamber 48.

Figure 9:
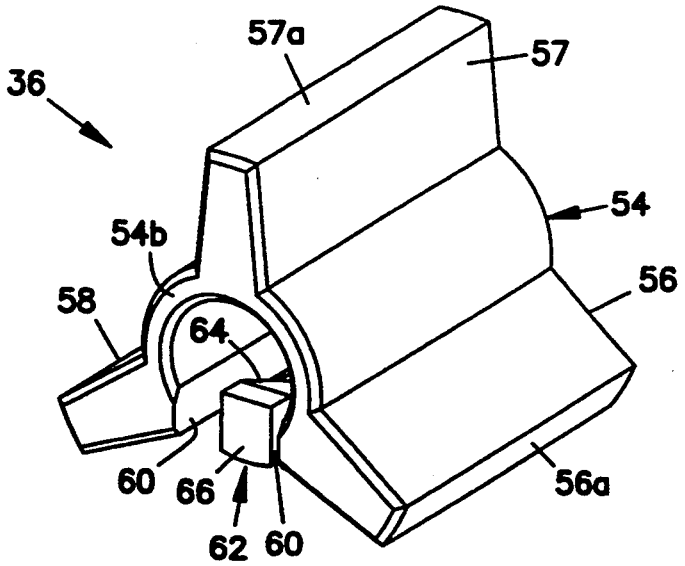
FIG. 9 is a front and top perspective view of a dielectric support for the connector of FIGS. 3–7.
Figure 10:
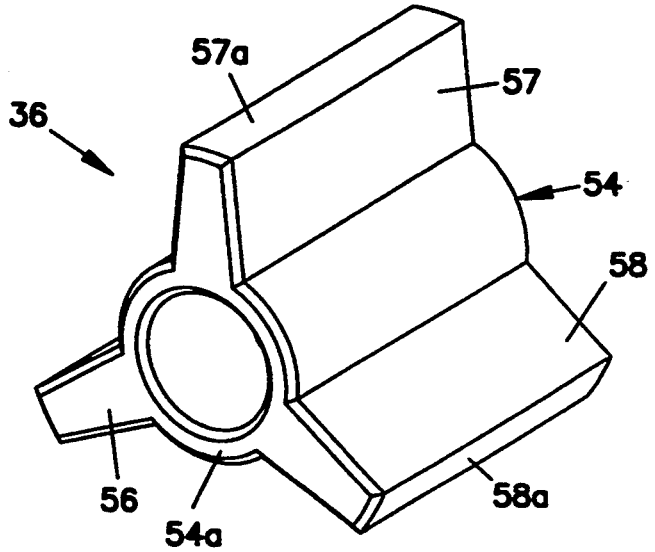
FIG. 10 is a rear perspective view of the support of FIG. 9.
Figure 11:
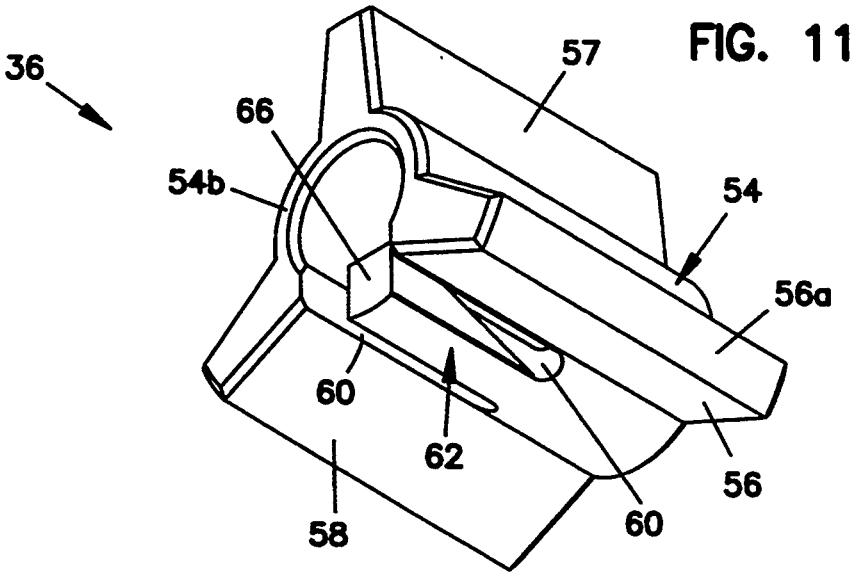
FIG. 11 is a front and bottom perspective view of the support of FIG. 9.
Figure 12:
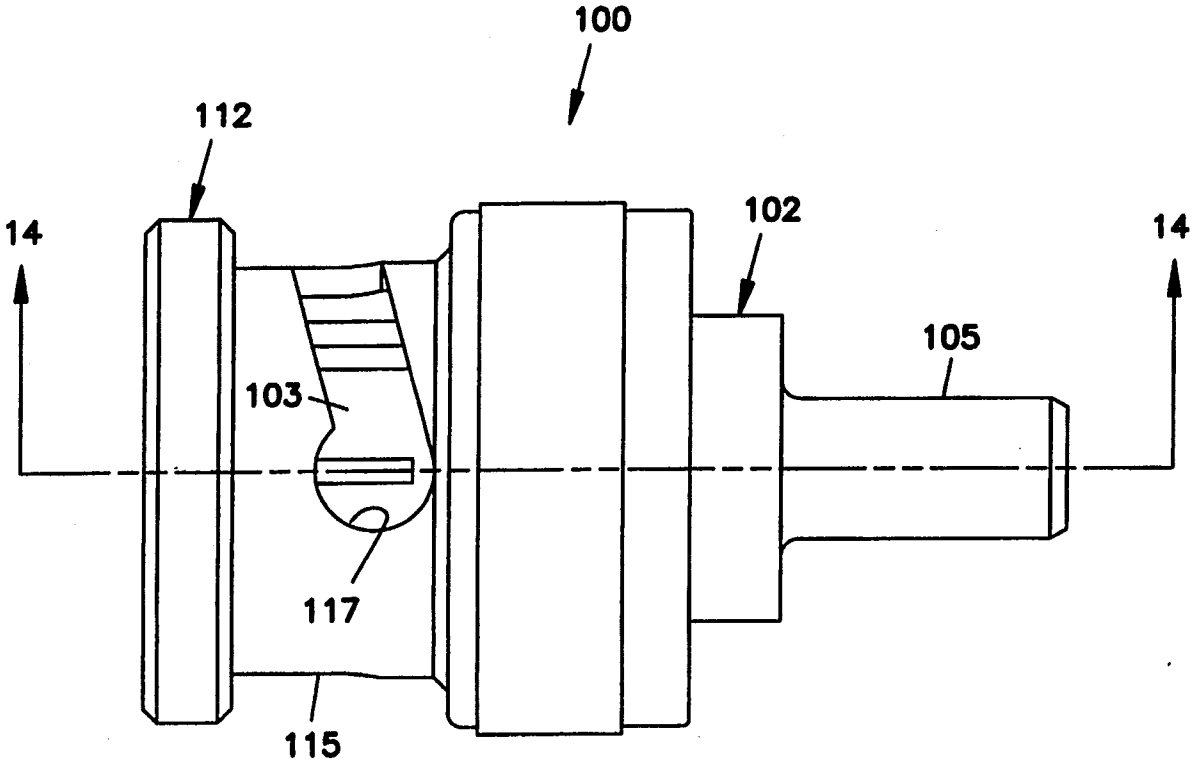
FIG. 12 is a top plan view of a mating connector for mating with the connector of FIG. 3.

The dielectric support 36 is best shown in FIGS. 9–11. The support 36 includes a cylindrical body 54 and three radially extending ribs 56,57,58 integrally formed with the body 54. Each of the ribs 56–58 is generally parallel to the axis of the cylindrical body 54 and is equally spaced around the circumference of the body 54. The distance from the center of the cylindrical body 54 to the outer radial edges **56*a*–58*a* of the ribs 56–58 is sized to be just slightly greater than the radius of the intermediate cylindrical chamber 48. Accordingly, the dielectric support 36 may be press-fit into the intermediate cylindrical chamber 48**.

The inner diameter of the dielectric body 54 is sized to be less than the diameter of bore 52 of crimp end 26. The outer diameter of body 54 is sized to be greater than the diameter of bore 52 in crimp end 26. Accordingly, a rear axial wall **54*a* of body 54 abuts against a radial wall 49 of the housing 22 (as shown in FIG. 6) when the support 36 is press-fit into chamber 48**.

Best illustrated in FIGS. 9 and 11, the body 54 is provided with two axially extending slots 60 between two contiguous ribs 56,58. The slots extend completely through the front axial surface **54*b* of the body 54**.

The material of the body 54 between the slots 60 is a cantilevered arm 62 extending generally parallel to the axis of the body 54. The arm 62 has a ramped cam surface 64 facing the rear end **54*a* of body 54. The arm 62 further terminates at a flat face 66 which is generally perpendicular to the axis of the body 54. The flat face 66 is thicker than body 54 such that its radial dimension (i.e., a dimension parallel to the radius of the body 54) projects into the body 54**.

Figure 8:
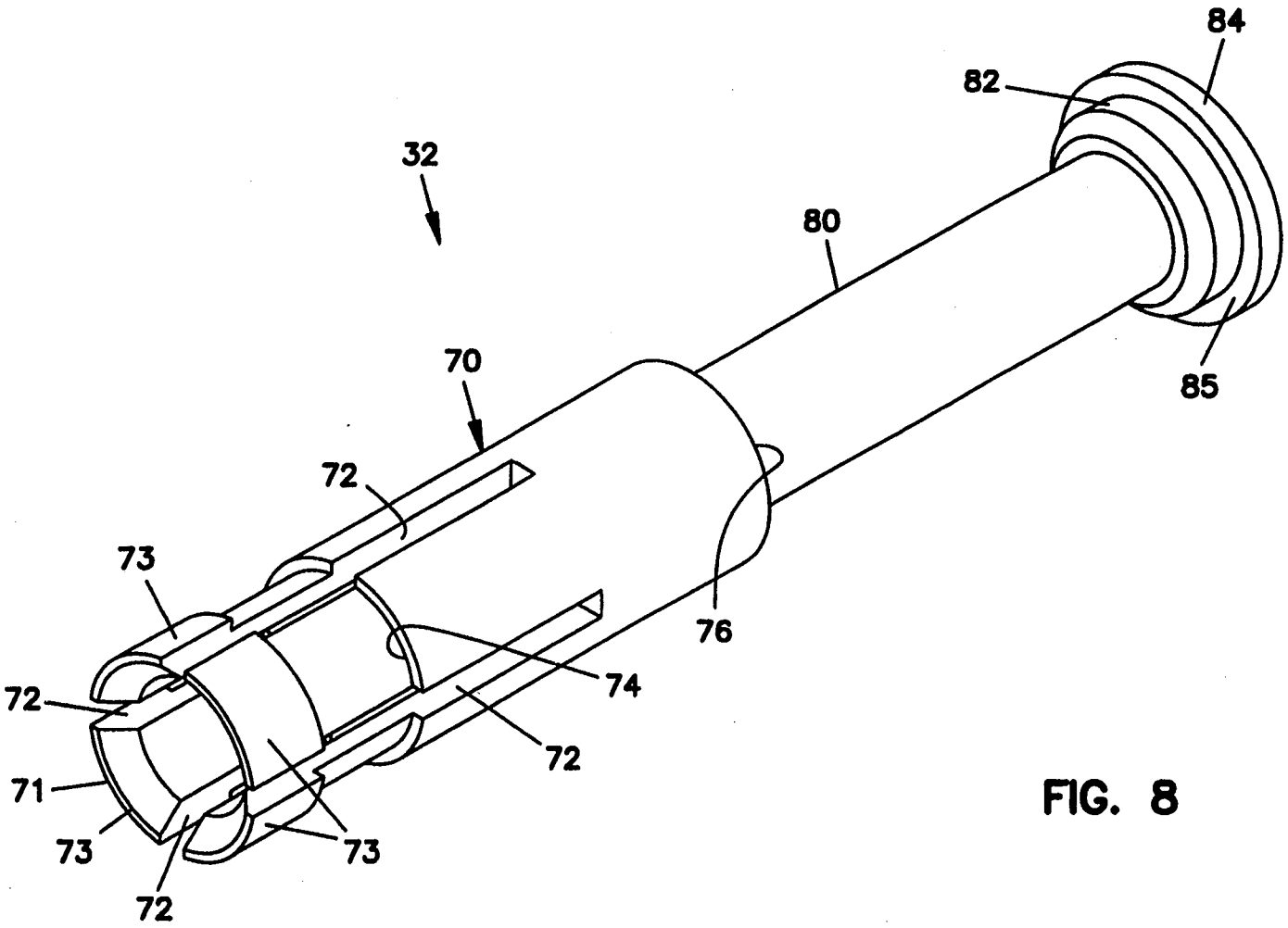
FIG. 8 is a perspective view of a center pin of the connector of FIGS. 3–7.

With reference now to FIGS. 7 and 8, center pin 32 will now be described. Center pin 32 includes a cylindrical mating end 70 having an outer diameter approximately equal to the inner diameter of body 54 of dielectric support 36. Mating end 70 is hollow and is provided with a plurality of axial slots 72 extending therethrough. The slots 72 divide end 70 into a plurality of resilient prongs 73 and permit a center pin 104 of mating connector 100 to be axially inserted into the open end 71 of mating end 70 with the pin 104 slightly urging the prongs 73 apart with the resilience of the prongs 73 providing sound electrical connection between the pin 104 and the pin 32 upon insertion. To prevent excessive flaring of the prongs 73, retaining ring 34 is carried on end 71 surrounding the prongs 73 and received within a annular groove 74 formed on the outer surface of the prongs 73.

Opposite open end 71, the mating end is provided with a flat radial surface 76. A reduced diameter, cylindrical intermediate portion 80 extends axially away from surface 76. Reduced diameter portion 80 is hollow and has an axially extending bore 81 (FIG. 7) therethrough. At the end of the reduced diameter portion 80 are a plurality of radial steps including a first radial step 82 having a diameter approximately equal to the inside diameter of body portion 54 of the dielectric support 36. A larger second step 84 is provided having a radial face 85 facing toward step 82. Step 84 is of a diameter less than the diameter of bore 52 but greater than the inside diameter of the body portion 54.

With the construction thus described, the dielectric support 36 is press-fit into chamber 48. The central conductor 12 of coaxial cable 10 is placed within the bore 81 by passing the conductor 12 through a flared entrance opening 81a formed in step 84. So inserted, the central portion 80 is crimped with any suitable crimping tool to mechanically secure the center pin 32 to the center conductor 12.

The open end 71 of the center pin 32 is then passed through bore 52 and through the dielectric support 36. As the center pin 32 is passed through the dielectric support 36, the center pin 32 urges against the cam surface 64 to deflect the cantilevered arm 62 radially outwardly to permit the center pin 32 to be passed. As the surface 76 of the center pin 32 passes the surface 66 of the cantilevered arm 62, the cantilevered arm 62 (due to its resilience and bias) snaps inwardly for the face 66 to oppose the surface 76.

The reduced diameter portion 80, the steps 82,84 and surface 85 are mutually sized and positioned such that when the flat surface 66 is abutting the surface 76, surface 85 of step 84 is facing and abutting the rear surface 54*a* of support 36. Accordingly, the center pin 32 is secured within the dielectric support 36 and cannot move axially therein. At this point, the dielectric sheathing 14 of the coaxial cable 10 is received within the bore 52 and the ground shield 16 is placed over the crimp end 26 and a crimp sleeve (not shown) is then placed over the ground shield 16 and crimped with any crimping tool to securely fasten the ground sleeve 16 to the crimp end 26 (as is conventional).

From time to time, it may be desirable to use the connector 20 with coaxial cables 10 having dielectric sheathing 14 of a diameter significantly smaller than the diameter of bore 52. To this end, optional spacer sleeve 38 is provided. The spacer sleeve 38 is a hollow cylinder having a flange 39 to limit the depth of insertion of the spacer sleeve 38 within bore 52. The spacer sleeve 38 is preferably metallic to provide structural support to the reduced diameter dielectric sheathing of the coaxial cable. When the optional spacer sleeve 38 is used, the dielectric ring 40 must be used to prevent electrical connection between the spacer sleeve 38 and the center pin 32 (to prevent electrical grounding of the center pin 32).

With the structure thus described, axial forces applied to the coaxial cable 10 and to the center conductor 12 do not result in the center pin 32 axially moving within the support 36 and, accordingly, intermittent loss of signal through the BNC connector 20 is avoided.

Figure 13:
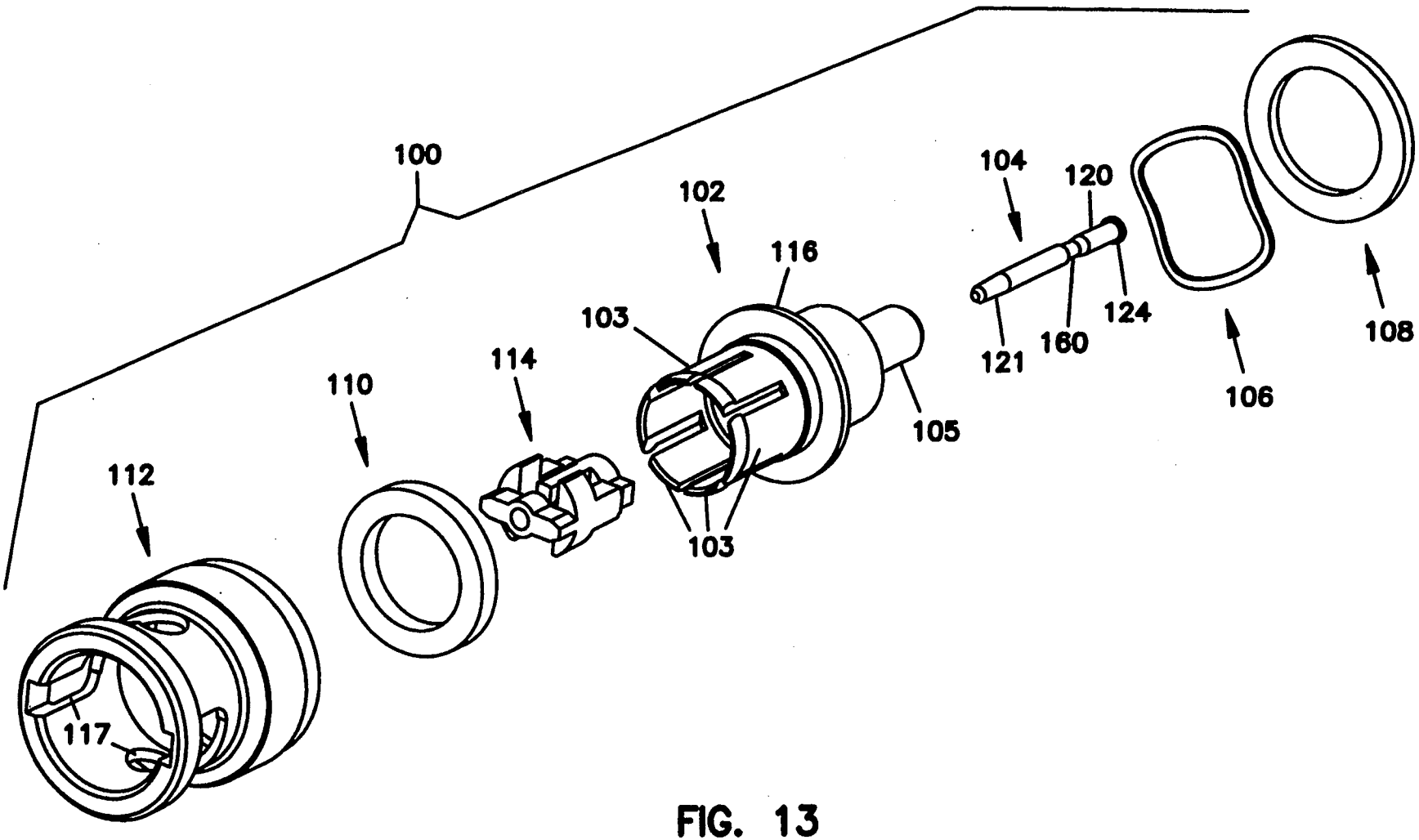
FIG. 13 is an exploded perspective view of the mating connector of FIG. 12.
Figure 14:
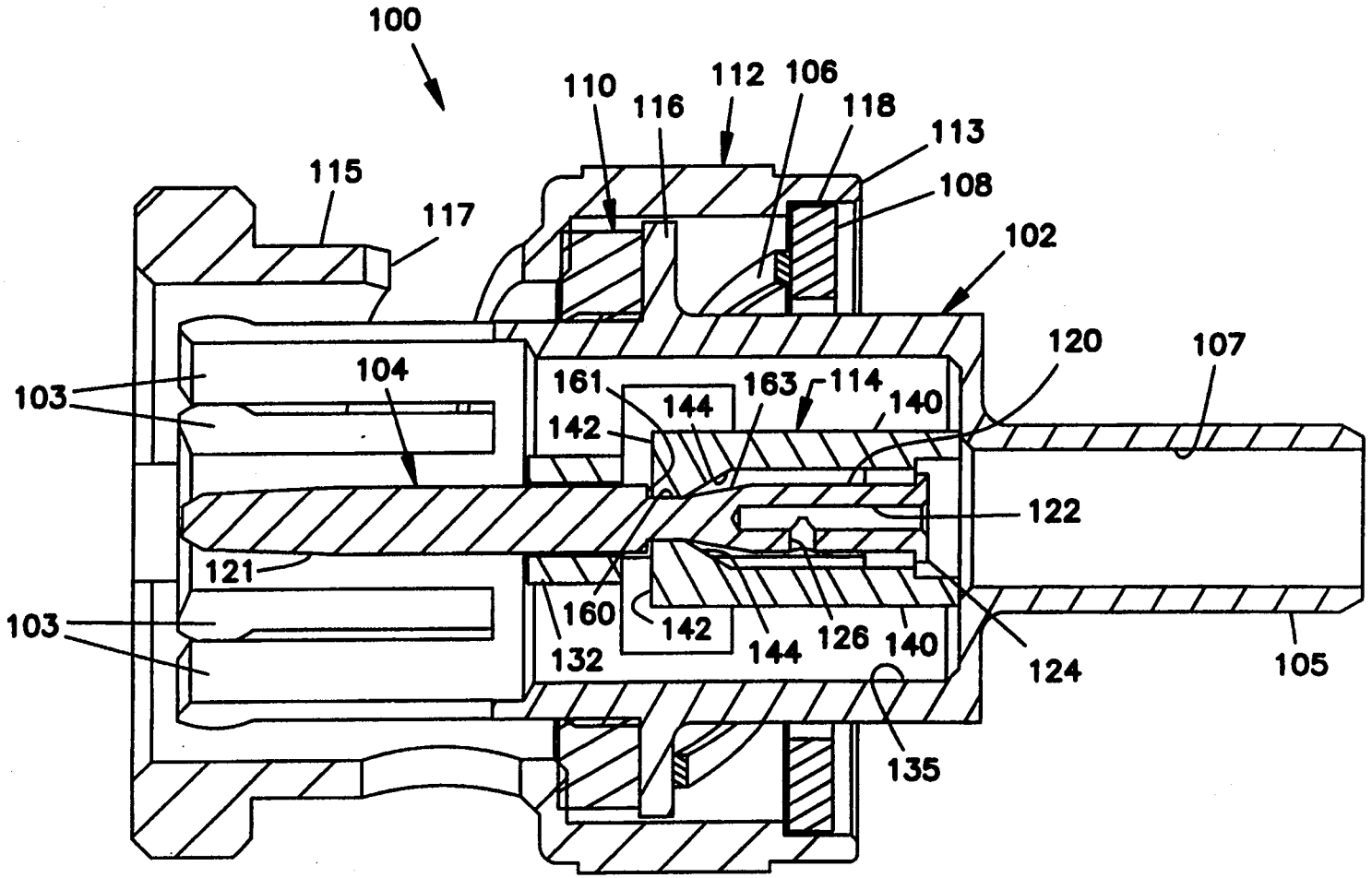
FIG. 14 is a view taken along line 14—14 of FIG.
Figure 15:
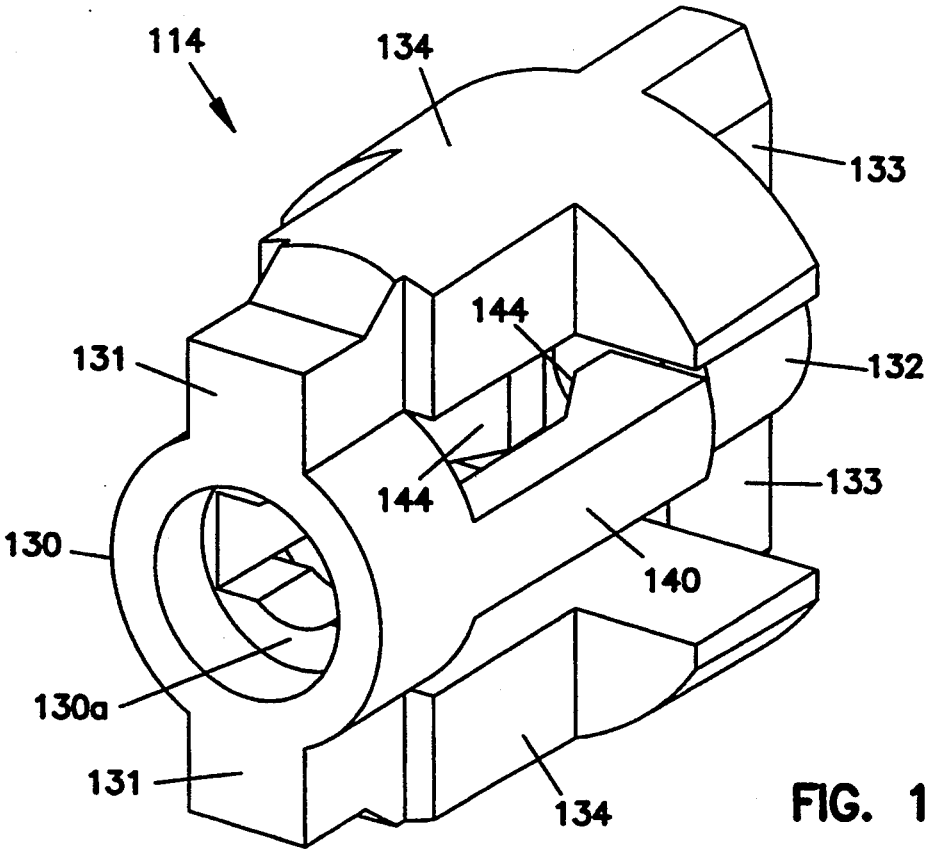
FIG. 15 is a rear, top and right side perspective view of a dielectric support for the connector of FIG. 12.
Figure 16:
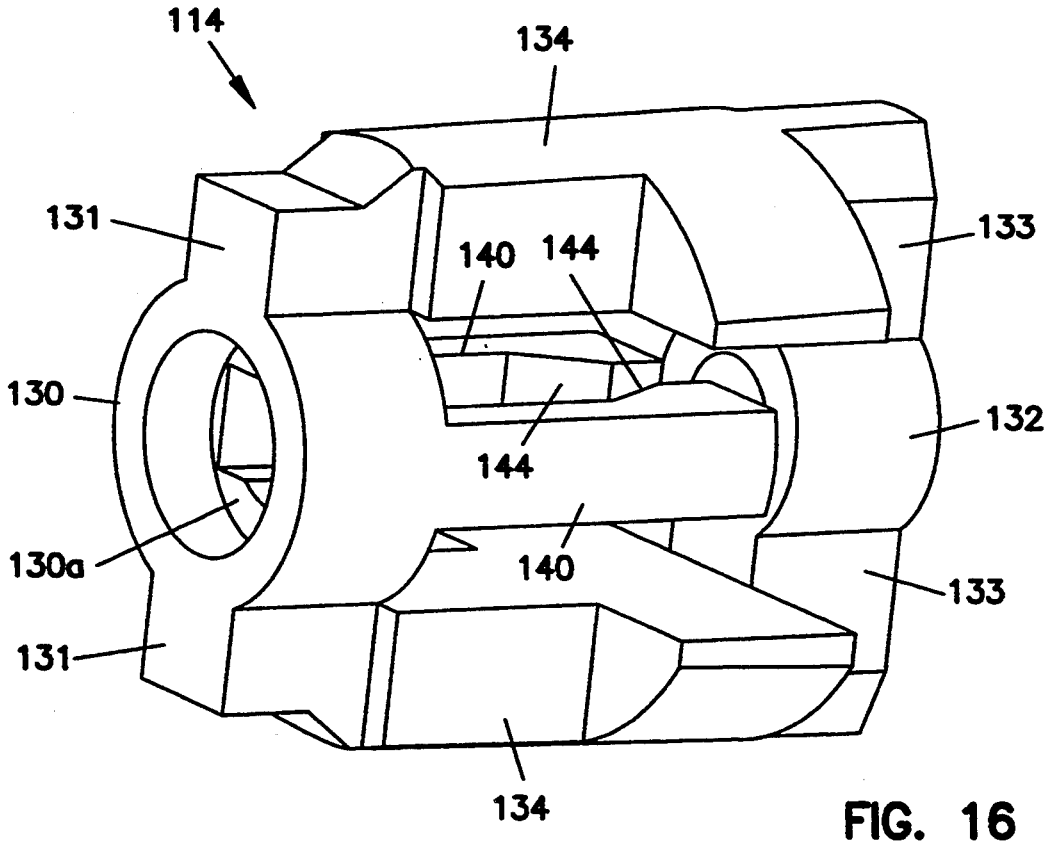
FIG. 16 is a rear, top and right side perspective view of the connector of FIG. 15 further rotated to show interior configurations with greater clarity.
Figure 17:
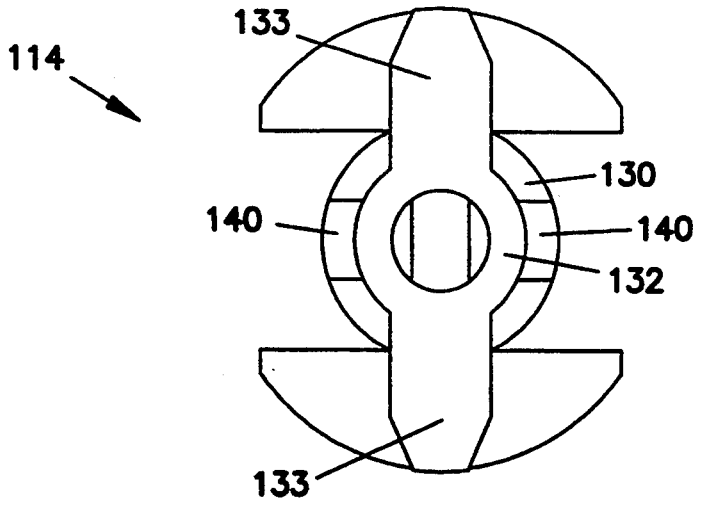
FIG. 17 is a front elevation view of the support of FIG. 15.
Figure 18:
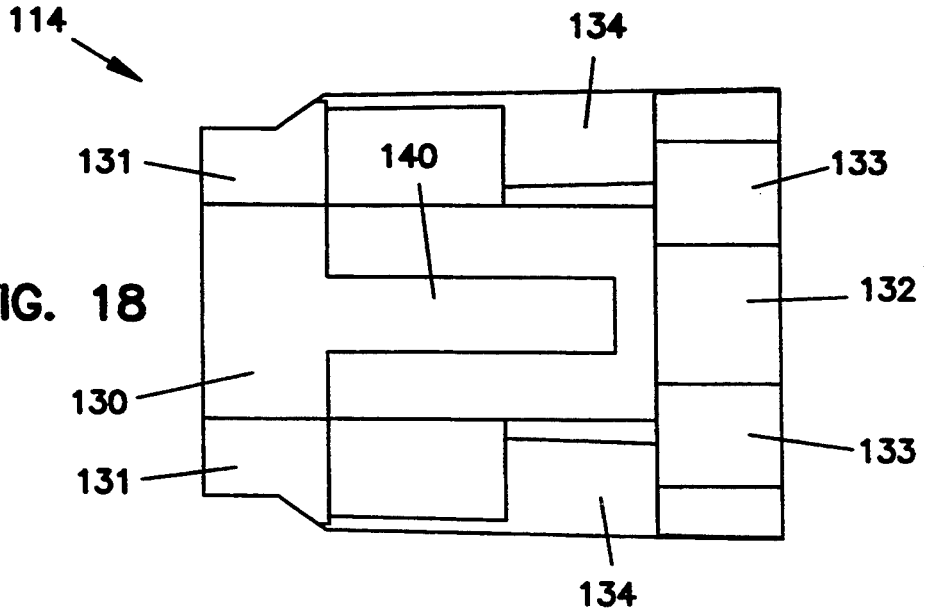
FIG. 18 is a side elevation view of the support of FIG. 15.
Figure 19:
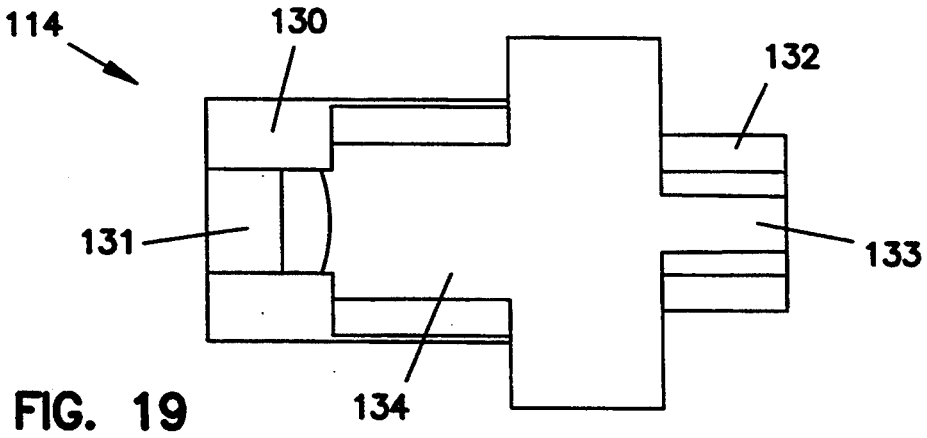
FIG. 19 is a top plan view of the support of FIG. 15.

FIGS. 12–19 illustrate a mating connector 100 for connection to connector 20. The mating connector 100 (as shown in FIG. 13) includes an electrically conductive housing 102, an electrically conductive center pin 104, a resilient spring 106 and a first washer 108. The mating connector 100 further includes a second washer 110, a connecting nut 112 and a dielectric support 114. With reference to FIG. 14, the housing 102 has a radial flange 116. The spring 106 is positioned on a rear side of the flange 116 between the flange 116 and the first washer 108.

The washer 108 is secured within the nut 112 by means of coining an edge 113 of the nut 112 over the washer 108. The term "coining" will be recognized by those in the art as referring to bending the edge 113 over the washer 108 to securely position the washer 108 within the nut 112. Accordingly, the washer 108 is received within a recess 118 of the nut 112.

The spring 106 acts against the washer 108 to move the nut 112 towards the right of the view of FIG. 14. The washer 110 is provided on an opposite side of the flange 116 abutting an interior radial surface of the nut 112.

An operator may urge the nut 112 forwardly to secure the nut to the connecting end 24 of first connector 20. Arcuate grooves 117 are formed in a forward cylindrical portion 115 of the nut 112. The inner surface of portion 115 slides over the outer surface of mating end 24 with the grooves 117 accommodating posts 46 to direct and lock the nut 112 onto housing 22 as is conventional.

Referring back to FIG. 13, the housing 102 includes a plurality of axially extending prongs 103 formed in a cylindrical array. Upon connection of the nut 112 to the end 24 of connector 20, the prongs 103 are resiliently biased to urge against the interior surface of end 24 to provide sound electrical grounding between housing 22 and housing 102.

The dielectric support 114 retains pin 104 centrally positioned within the housing 102. The pin 104 is positioned to be received within the pin 32 of connector 20 as the connectors 20,100 are axially moved toward one another.

The rear end of pin 104 includes an bore 122 (FIG. 14) extending axially through a flanged end 124 of pin 104. A radial bore 126 is formed in end 120 in communication with bore 122.

With best reference to FIGS. 15–19, the dielectric support 114 is integrally molded insulating material that includes a rear ring 130 and a forward ring 132. Ring 130 has an interior diameter sized approximate to an exterior diameter of a forward end 121 of pin 104. Ring 132 is sized with an interior diameter greater than the diameter of flange 124.

Each of rings 130,132 are provided with radially extending beams 131,133. The beams 131,133 are connected by rails 134 which have arcuate surfaces for presenting an outside diameter equal to the inside diameter of an intermediate chamber 135 (FIG. 14) of the housing 102 such that the insulator 114 may be press-fit into housing 102. The geometry of the insulator 114 is selected for the characteristic impedance of the connector 100 to equal a prescribed characteristic impedance (such as 75 ohms). It will be appreciated by those skilled in the art that modifying geometry of components of electrical connectors to achieve a desired impedance is well within the skill of the art.

Extending from ring 130 in a direction parallel to the axis of the connector 100 are two cantilevered arms 140. Each of the cantilevered arms 140 terminate at flat radial surfaces 142 and have opposing cam surfaces 144.

Separating the ends 121 and 120 of pin 104 is a reduced diameter portion 160 which joins front end 121 at a flat radial surface 161 (FIG. 14) and connects to end 120 by a ramped surface 163.

To assemble the pin 104 into the support 114, the support 114 is press-fit within the housing 102. The central conductor of a coaxial cable is placed within the bore 122 and secured therein by applying solder through bore 126. The pin 104 is then inserted through a crimp end 105 with the pin 104 passing through rings 130,132.

As the pin 104 passes through the support 114, the pin 104 acts against the cam surfaces 144 of the cantilevered arms 140 to urge the cantilevered arms 140 outwardly against their bias. This permits the pin 104 to pass until such time as surface 161 passes surfaces 142 at which point the cantilevered arms 140 (due to their resilience) snap into place with surfaces 142 opposing surfaces 161. At this point, flange 124 is opposing and abutting an interior stop surface 130*a* (FIG. 15) formed within ring 130. Accordingly, the pin 104 is restricted from axial movement relative to support 114.

The dielectric sheathing of the coaxial cable is received within the bore 107 of the crimp end 105 and the ground shield of the cable is placed over the exterior surfaces of the crimp 105 and crimped thereto by any suitable crimping means (including a crimping sleeve, not shown) crimped onto the crimp end 105 with any suitable crimping tool.

Figure 20:
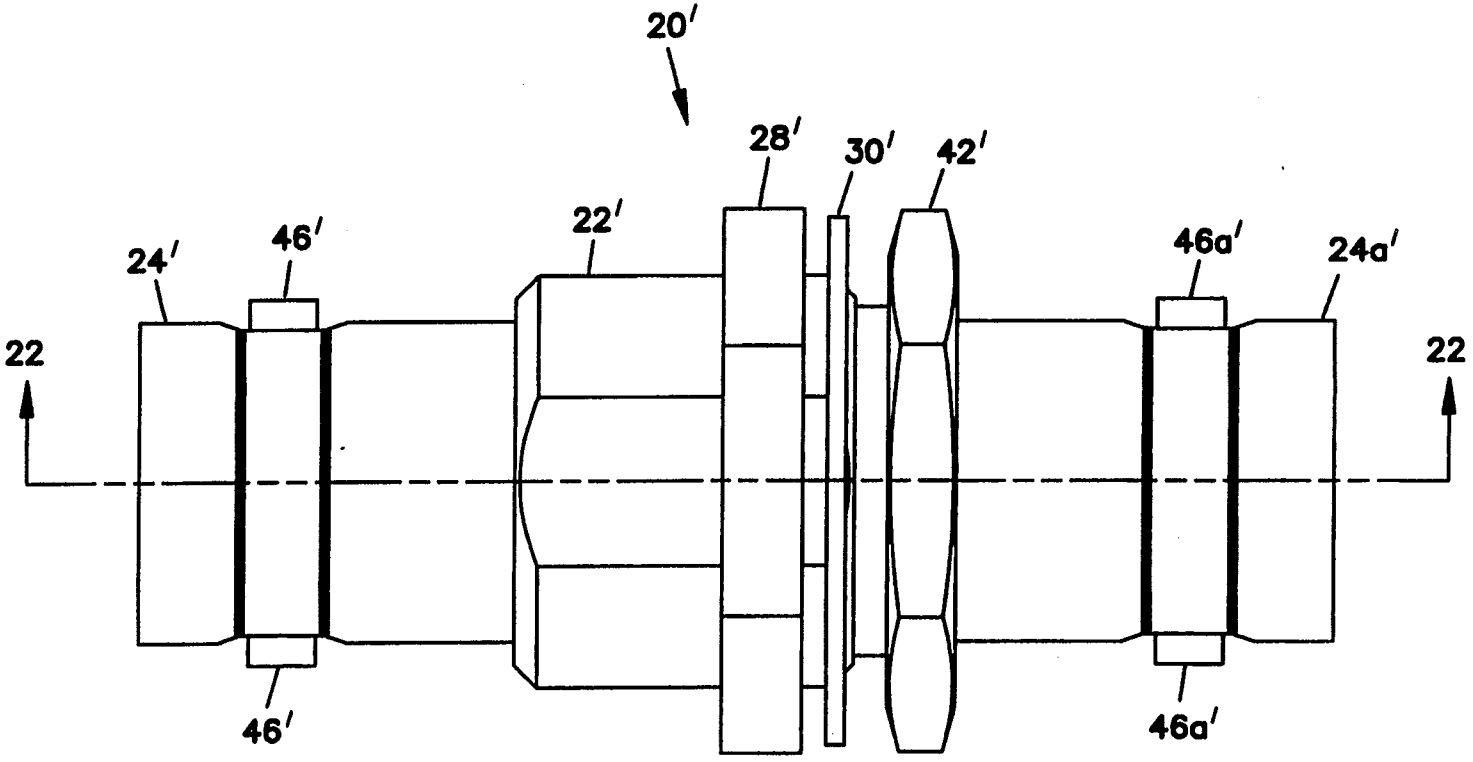
FIG. 20 is a top plan view of a further embodiment of a connector according to the present invention.
Figure 21:
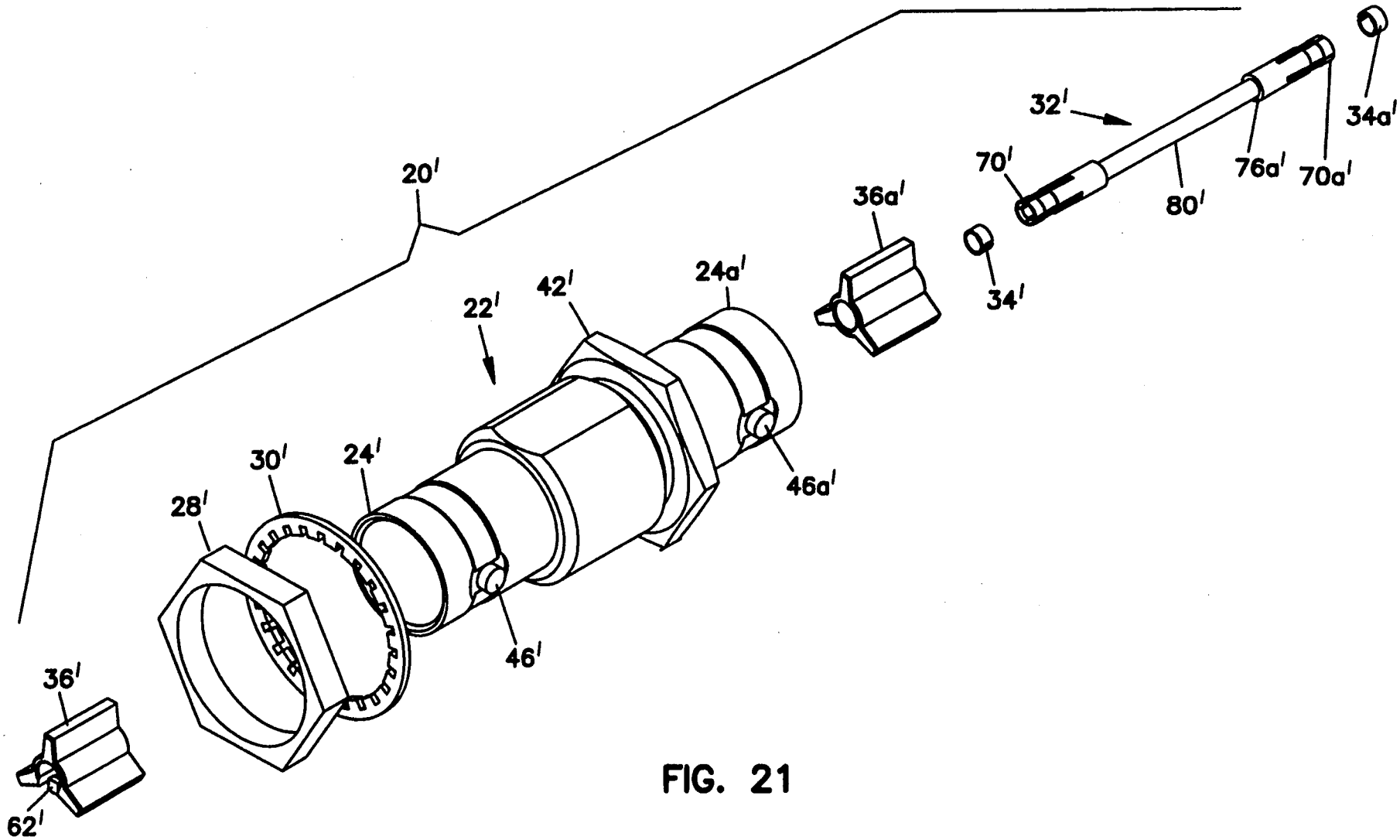
FIG. 21 is an exploded perspective view of the embodiment of FIG. 20.
Figure 22:
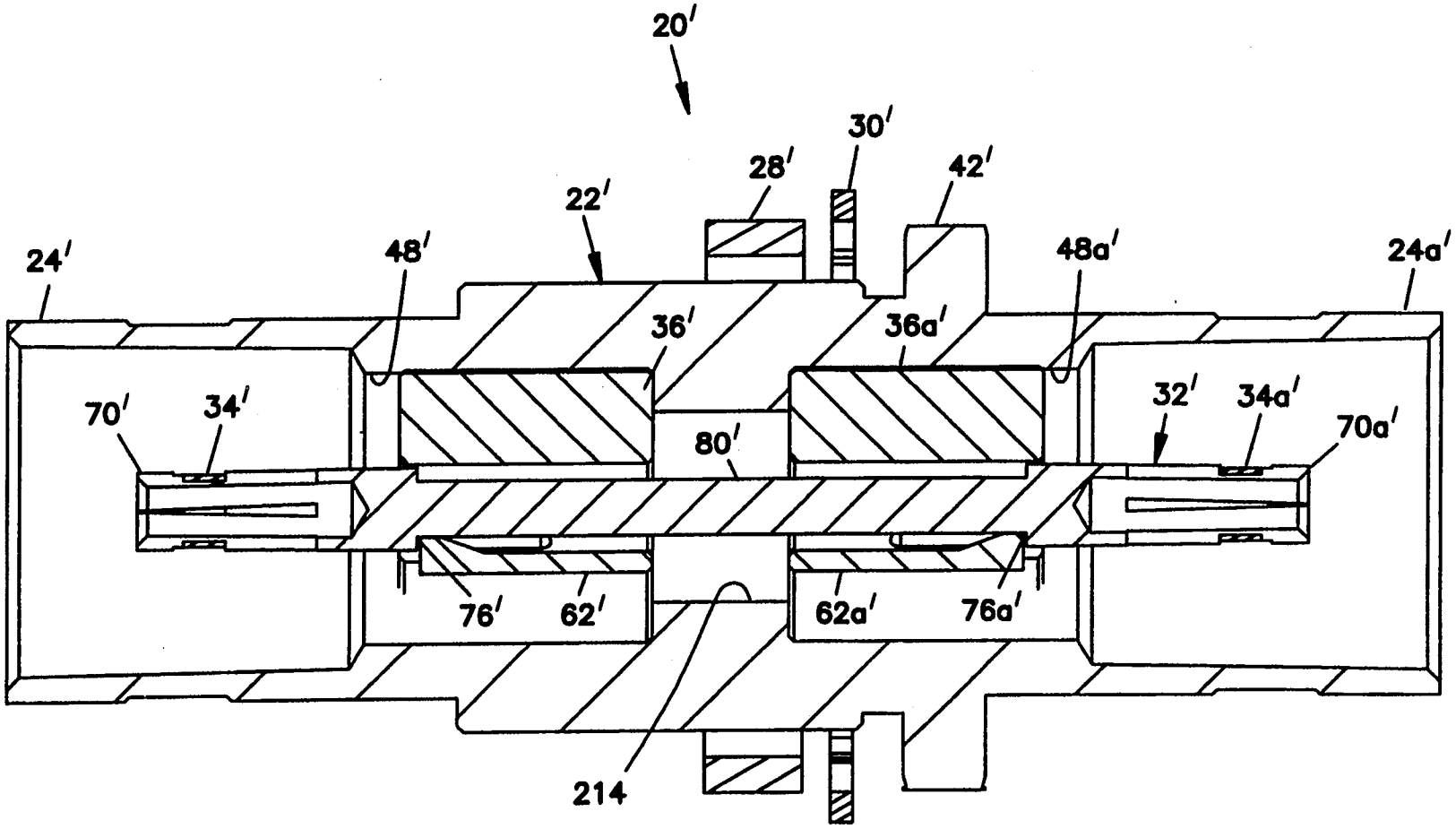
FIG. 22 is a view taken along line 22—22 of FIG. 20.

From time to time, it is desirable to provide a BNC connector which can be mounted to a sheet metal panel and present on both sides a connector such as that of connector 20. To this end, the embodiment of a connector 20' shown in FIGS. 20–22 is directed. Referring to these figures and with the benefit of the teachings of the present application with reference to FIGS. 1 through 11, the connector 20' includes a housing 22' with cylindrical mating sleeves 24',24a' on opposite sides of the connector 20'. Each of the sleeves 24',24a' is provided with radially extending posts 46',46a' for connection to a connector 100 such as that of the embodiment of FIG. 14.

The connector 20' includes a flange 42', nut 28', and washer 30' for connection of the connector 20' to a sheet metal panel in a manner similar to that of the embodiment of FIG. 5.

The connector 20' includes two intermediate chambers 48',48a' (FIG. 22) separated by an inwardly projecting ring 214. Dielectric supports 36',36a' (each of which are identical to dielectric support 36 of FIGS. 9–11) are press-fit within the chambers 48',48a'. A center pin 32' having connecting ends 70',70a' (each of which is identical to connecting end 70 of FIG. 8) are provided connected by a common cylindrical rod portion 80' of a diameter smaller than the diameter of ends 70',70a'. The connecting ends 70',70a' terminate at radial support surfaces 76',76a'. With the structure thus disclosed, dielectric support 36' is press-fit into chamber 48'. Dielectric support 36a' is passed over end 70a' until surface 76a' passes cantilevered arm 62a'. End 70' is passed through support 36' until surface 76' passes the cantilevered arm 62' of support 36'. Simultaneously,, support 36a' is press-fit into chamber 48a'. At this point, the complete assembly of FIG. 22 has been achieved and the pin 32' is prevented from axial movement within the housing.

From the foregoing detailed description, the present invention has been shown how the objects of the invention have been achieved in a preferred embodiment. However, modifications and equivalents of the disclosed concepts such as those which readily occur to one skilled in the art are intended to be included within the scope of the present invention.

What is claimed is:

1. A coax connector comprising:

a conductive housing having a first and second end, said first end open to expose a housing interior;

an electrically conductive center pin disposed within said housing and having a first end for slidable and releasable connection to a center pin of a mating connector;

dielectric support means for mounting said center pin within said housing interior in spaced, electrically insulated relation to said housing and with said first end of said center pin exposed through said open first end of said housing;

lock means for securing said center pin to said dielectric support means to restrict axial movement of said center pin relative to said support means;

said support means including a body having an opening formed therethrough and sized to pass said first end of said center pin; said center pin including a reduced diameter portion defined a receiving slot disposed between a first and a second shoulder, said body including a cantilevered lock having a free end exposed to said opening, said lock movable between a lock position and an unlock position;

in the lock position, said lock free end disposed within said receiving slot and opposing said first shoulder, said lock resiliently biased to said lock position with said free end disposed to be urged against said pin to said unlock position by said free end of said pin upon passing of said first end through said opening of said body to said predetermined position.

2. A connector according to claim 1 wherein said center pin and said first end of said lock include first opposing stop surfaces to stop movement of said center pin away from said predetermined position.

3. A connector according to claim 2 wherein said center pin and support means include second opposing stop surfaces mutually position to stop movement of said center pin beyond said predetermined position.

* * * * *